US007894758B2

(12) United States Patent
Shintani et al.

(10) Patent No.: US 7,894,758 B2
(45) Date of Patent: Feb. 22, 2011

(54) IMAGE FORMING APPARATUS, IMAGE FORMING DEVICE CHARGING DEVICE AND LUBRICANT SUPPLYING DEVICE CONSTITUTION

(75) Inventors: Takeshi Shintani, Kawasaki (JP); Hiroshi Ono, Ohta-ku (JP); Satoshi Hatori, Yokohama (JP); Kaoru Yoshino, Setagaya-ku (JP); Akio Kosuge, Yokohama (JP); Takaya Muraishi, Kawasaki (JP); Ken Amemiya, Nerima-ku (JP); Yoshiki Hozumi, Sagamihara (JP); Atsushi Sampe, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 731 days.

(21) Appl. No.: 11/855,353

(22) Filed: Sep. 14, 2007

(65) Prior Publication Data

US 2008/0069615 A1 Mar. 20, 2008

(30) Foreign Application Priority Data

Sep. 15, 2006 (JP) ..... 2006-251642

(51) Int. Cl.
*G03G 21/00* (2006.01)

(52) U.S. Cl. ..... 399/346; 399/168

(58) Field of Classification Search ..... 399/346, 399/168

See application file for complete search history.

(56) References Cited

U.S. PATENT DOCUMENTS 6,295,438 B1 * 9/2001 Fujishiro et al. ..... 399/346
7,228,099 B2 6/2007 Shintani et al.
7,715,761 B2 * 5/2010 Uda et al. ..... 399/168
2005/0169663 A1 8/2005 Shintani et al.
2006/0002736 A1 1/2006 Kikuchi et al.
2006/0039726 A1 2/2006 Shintani et al.
2006/0045603 A1 3/2006 Hatori et al.
2006/0110184 A1 5/2006 Yoshino et al.

(Continued)

FOREIGN PATENT DOCUMENTS

JP 2000-338819 12/2000

(Continued)

OTHER PUBLICATIONS

JP 2001051467; Abstract JP 2001051467; Machine Translation JP 2001051467.*

(Continued)

*Primary Examiner*—David P Porta
*Assistant Examiner*—Bryan P Ready
(74) *Attorney, Agent, or Firm*—Oblon, Spivak, McClelland, Maier & Neustadt, L.L.P.

(57) ABSTRACT

An image forming apparatus including a plurality of image forming devices each including a photosensitive member, a charging device to charge a surface of the photosensitive member, and a lubricant supplying device to supply a lubricant to the surface of the photosensitive member, respectively. At least one of the plurality of image forming device includes a charging device with a different constitution from a constitution of a charging device of another of the image forming devices, and the one of the plurality of image forming devices with the different charging device includes a lubricant supplying device with a different constitution from a constitution of a lubricant supplying device of the another of the image forming devices.

12 Claims, 4 Drawing Sheets

U.S. PATENT DOCUMENTS

| | | | |
|---|---|---|---|
| 2006/0133834 | A1 | 6/2006 | Yoneda et al. |
| 2007/0059035 | A1 | 3/2007 | Yoshino et al. |
| 2007/0071525 | A1 | 3/2007 | Yoshino et al. |

FOREIGN PATENT DOCUMENTS

| | | | | |
|---|---|---|---|---|
| JP | 2001051467 | A | * | 2/2001 |
| JP | 2001-324843 | | | 11/2001 |
| JP | 2002341618 | A | * | 11/2002 |
| JP | 2004-151612 | | | 5/2004 |
| JP | 2005-084292 | | | 3/2005 |
| JP | 2005-309406 | | | 11/2005 |
| JP | 2005-346028 | | | 12/2005 |
| JP | 2006-030955 | | | 2/2006 |

OTHER PUBLICATIONS

JP 2002341618; Abstract JP 2002341618.*
U.S. Appl. No. 11/857,070, filed Sep. 18, 2007, Kosuge.
U.S. Appl. No. 12/167,564, filed Jul. 3, 2008, Hatori et al.
U.S. Appl. No. 12/134,701, filed Jun. 6, 2008, Kosuge, et al.

* cited by examiner

IMAGE FORMING APPARATUS, IMAGE FORMING DEVICE CHARGING DEVICE AND LUBRICANT SUPPLYING DEVICE CONSTITUTION

CROSS-REFERENCE TO RELATED APPLICATIONS

The present application claims priority to Japanese patent application no. 2006-251642, filed in the Japan Patent Office on Sep. 15, 2006, the disclosure of which is incorporated by reference herein in its entirety.

BACKGROUND OF THE INVENTION

1. Field of the Invention

The present invention relates to a copying apparatus, a facsimile apparatus, a printer, or the like, utilizing an electrostatic image transfer process, and more specifically to an image forming apparatus that includes at least first and second image forming devices each including a photosensitive member, a charging device to charge a surface of the photosensitive member, and a lubricant supplying device to supply a lubricant to the surface of the photosensitive member, respectively.

2. Discussion of the Background

Japan Laid-Open Patent Publication no. 2001-051467 discloses a color image forming apparatus having a plurality of image forming devices. A constitution of a charging device of one of the plurality of image forming sections is different from a constitution of a charging device of the other plurality of image forming sections.

The image forming device used for forming black images has a charging unit that includes a non-contact type charging wire to have applied a charging bias having a direct current component, and the other image forming devices used for forming color images have a contact type charging unit that includes a charging roller to have applied a charging bias having an alternate current component and a direct current component.

Japan Laid-Open Patent Publication no. 2000-338819 discloses a color image forming apparatus that includes a lubricant supplying device, which can decrease a wear of a photosensitive member, improve a cleaning efficiency of residual toner on the photosensitive member after transferring, and prevent filming and adhesion of toner components on the surface of the photosensitive member.

It is common that a plurality of the image forming devices include a lubricant supplying device having the same constitution.

SUMMARY OF THE INVENTION

An object of the present invention is to enhance operation of image forming devices by utilizing appropriate charging devices and lubricant applying devices for different image forming devices.

A further object of the present invention is to provide a novel image forming apparatus that overcomes drawbacks in the above-noted background art.

To realize the above and other objects, the present invention provides a novel image forming apparatus including a plurality of image forming devices each including a photosensitive member, a charging device to charge a surface of the photosensitive member, and a lubricant supplying device to supply a lubricant to the surface of the photosensitive member, respectively. At least one of the plurality of image forming device includes a charging device with a different constitution from a constitution of a charging device of another of the image forming devices, and the one of the plurality of image forming devices with the different charging device includes a lubricant supplying device with a different constitution from a constitution of a lubricant supplying device of the another of the image forming devices.

The objects, features, and advantages of the present invention will become apparent upon consideration of the following description of preferred embodiments of the present invention taken in conjunction with the accompanying drawings.

BRIEF DESCRIPTION OF THE DRAWING

The accompanying drawings, which are incorporated in and constitute a part of the specification, illustrate the invention, and, together with the description, serve to explain the principles of the present invention.

DESCRIPTION OF THE PREFERRED EMBODIMENTS

Figure 1:
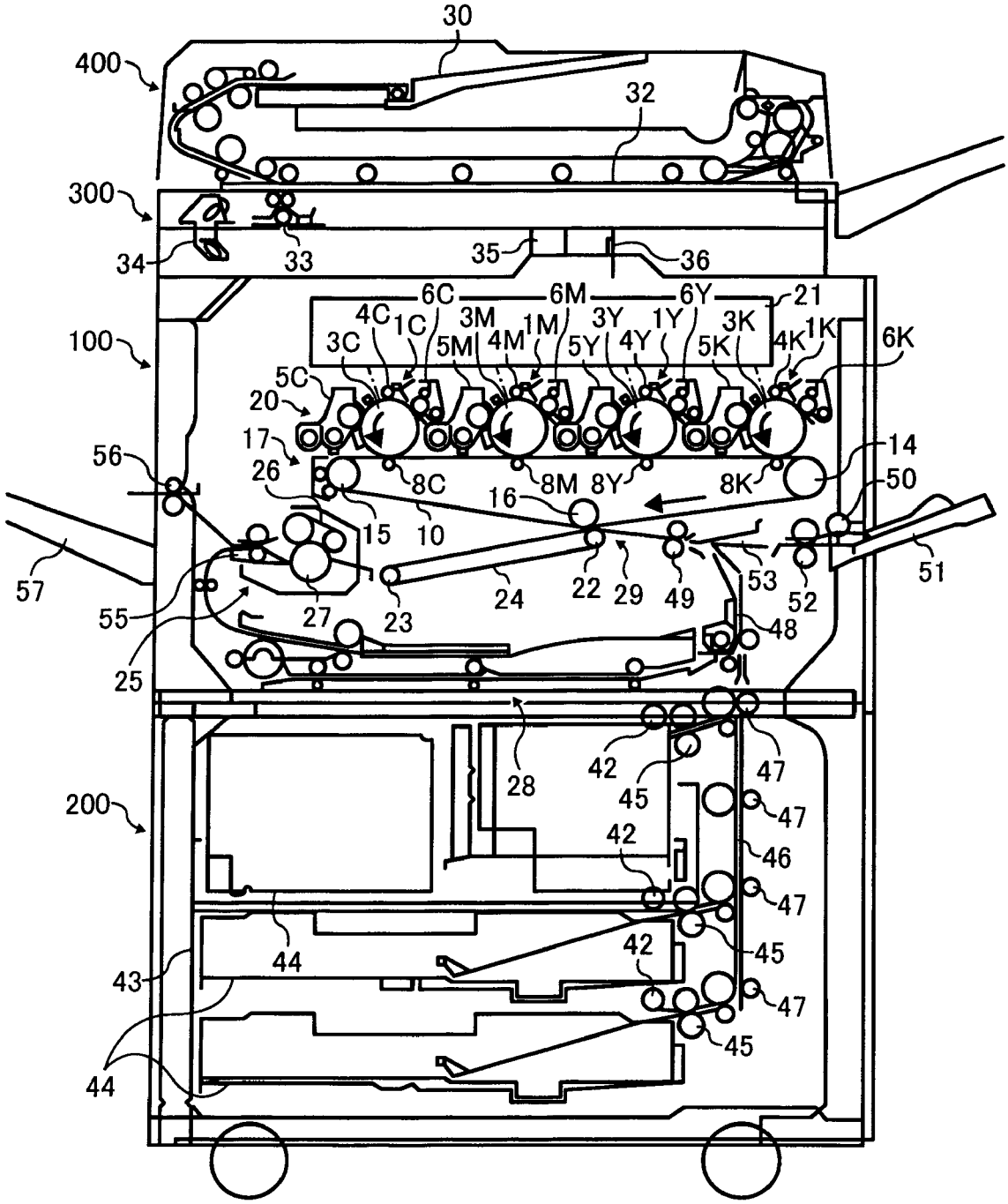
FIG. 1 is a schematic structure of an image forming apparatus according to an embodiment of the present invention.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

Referring now to the drawings, wherein like reference numerals designate identical or corresponding parts throughout the several views, preferred embodiments of the present invention are described.

Referring to FIG. 1, a structure of a tandem type color image forming apparatus is shown as an example of an image forming apparatus according to an exemplary first embodiment of the present invention. FIG. 1 shows a block diagram of a copier, according to an embodiment of the present invention.

The copier has a main body that includes an image forming section 100, a sheet feeding unit 200, an image scanning unit 300, and a document conveying unit 400. The image scanning unit 300 is located above the image forming section 100. The document conveying unit 400 includes an automatic document feeder (ADF) located above the image scanning unit 300. Moreover, the copier includes a control unit (not shown) that controls the operations of various units of the copier.

The image forming section 100 includes an intermediate transfer belt 10, serving as an intermediate transfer member. The intermediate transfer belt 10 is looped over a first roller 14, a second roller 15, and a third roller 16, and is driven clockwise.

Four image sensitive members 3K, 3Y, 3M and 3C respectively for black, yellow, magenta, and cyan color toner images are arranged along a surface of the intermediate transfer belt 10.

Charging devices 4K, 4Y, 4M and 4C each as a charging unit to charge a surface of the respective photosensitive members 3K, 3Y, 3M and 3C, and developing devices 5K, 5Y, 5M and 5C each as a developing unit to develop the toner images on the surface of the respective photosensitive members 3K, 3Y, 3M and 3C, are arranged around the respective photosensitive members 3K, 3Y, 3M and 3C.

In addition, lubricant supplying devices 6K, 6Y, 6M and 6C to supply a lubricant to the surfaces of the photosensitive members 3K, 3Y, 3M and 3C are arranged around the photosensitive members 3K, 3Y, 3M and 3C, respectively. The lubricant supplying devices 6K, 6Y, 6M and 6C each include a cleaning member to remove residual toner remaining on the surfaces of the photosensitive members 3K, 3Y, 3M and 3C after a first transfer. Image forming devices 1K, 1Y, 1M and 1C include the photosensitive members 3K, 3Y, 3M and 3C, the developing devices 5K, 5Y, 5M and 5C, the charging devices 4K, 4Y, 4M and 4C and the cleaning devices 6K, 6Y, 6M and 6C, respectively. Four image forming devices 1K, 1Y, 1M and 1C are arranged horizontally in a tandem image forming unit 20.

The intermediate transfer belt 10 includes an intermediate transfer belt cleaning device 17. The intermediate transfer belt cleaning device 17 removes residual toner remaining on the outer circumferential surface of the intermediate transfer belt 10 after secondary transferring at a secondary transferring nip positioned between the intermediate transfer belt 10 and a secondary image transferring device 29.

An exposing unit 21 is positioned above the tandem image forming unit 20 in the image forming section 100.

First transferring rollers 8K, 8Y, 8M and 8C are arranged inside of the intermediate transfer belt 10 at an opposite side of the photosensitive members 3K, 3Y, 3M and 3C, respectively. The first transferring rollers 8K, 8Y, 8M and 8C are pressed against the photosensitive members 3K, 3Y, 3M and 3C nipping the intermediate transferring belt 10 between the first transferring rollers 8K, 8Y, 8M and 8C and the photosensitive members 3K, 3Y, 3M and 3C to form a first transferring nip as a first image transferring portion.

The secondary image transferring device 29, including the secondary transfer belt 24, is arranged at an opposite side of the tandem image forming unit 20 across the intermediate transfer belt 10. The secondary transfer belt 24 is looped over a secondary image transferring roller 22 and a secondary transfer belt support roller 23. The secondary transfer belt 24 of the secondary image transferring device 29 is pressed against the third roller 16 nipping the intermediate transfer belt 10 between the secondary transfer belt 24 and the third roller 16 to form a secondary transferring nip as a secondary image transferring portion.

A fixing device 25 is positioned at one side of the secondary image transferring device 22 for fixing a toner image on a sheet or similar recording medium. The fixing device 25 includes an endless belt 26 and a press roller 27 pressed against the belt 26.

The secondary image transferring device 29 additionally functions to convey the sheet to the fixing device 25 after secondary image transferring. The secondary image transferring device 29 may, of course, be implemented as a charger that does not contact the intermediate transfer belt 10. With a charger, however, it is difficult to implement the sheet conveying function.

A turning device 28 is positioned below the secondary image transferring device 29 and the fixing device 25 to turn the sheet upside down for a duplex copy mode. The turning device 28 extends in parallel to the tandem image forming device 20. The turning device 28 turns the sheet upside down and then delivers the upside down sheet to the secondary image transferring position.

The image scanning unit 300 includes an image reading sensor 36 to read image information from documents positioned on an exposure glass 32 and to send the read image information to the control unit. Based on the image information that is received from the image scanning unit 300, the control unit controls a laser, an LED, or the like (not shown) positioned in the exposing unit 21 that irradiates writing laser beams onto photosensitive members 3K, 3Y, 3M, and 3C. Through this irradiation, latent electrostatic images are formed on the surfaces of the photosensitive drums 3K, 3Y, 3M, and 3C and the latent images are developed into respective toner images through image developing processes.

The sheet feeding unit 200 includes a media bank 43 into which a plurality of sheet feeding cassettes 44 are inserted. A plurality of sheet feeding rollers 42 extract respective sheets of a recording medium P (e.g., paper) from any one of the sheet feeding cassettes 44, and a plurality of sheet separating rollers 45 separate the sheets of the recording media P and feed each sheet sequentially to a sheet feeding path 46. Sheet conveying rollers 47 feed the recording media P to a sheet feeding path 48 of the image forming section 100.

In addition to the sheet feeding unit 200, manual sheet feeding is possible using a manual sheet feeding tray 51 that is located on the side of the image forming apparatus, from which the recording media P is fed separated sheet-by-sheet by a sheet separating roller 52.

A register roller 49 discharges, e.g., the recording media P one sheet at a time, from any one of the sheet feeding cassettes 44 or the manual sheet feeding tray 51, and sends the recording media P to the secondary image transferring nip.

When making copies of color documents, the color document is set on a document stand 30 of the document conveying unit 400, or the document conveying unit 400 is opened and the document is set on the exposure glass 32 of the image scanning unit 300. Then, upon operating a START key (not shown), the document that is set at the document conveying unit 400 is conveyed onto the exposure glass 32, and the image scanning unit 300 is activated.

If, on the other hand, a document is manually placed on the exposure glass 32 and the START key is operated, the image scanning unit 300 is activated immediately to move a primary scanning member 33 and a secondary scanning member 34. Light is emitted from a light source at the primary scanning member 33, light reflects off the surface of the document, and is further reflected towards the secondary scanning member 34. A mirror at the secondary scanning member 34 reflects the light through an imaging lens 35 onto the image reading sensor 36 that reads the image information.

The charging devices 4K, 4Y, 4M and 4C uniformly charge surfaces of the respective photosensitive members 3K, 3Y, 3M and 3C. The surfaces of the photosensitive members 3K, 3Y, 3M and 3C are exposed by the exposing unit 21 corresponding to image data read by the image scanning unit 300 to form electrostatic latent images on the photosensitive members 3K, 3Y, 3M and 3C, respectively.

The electrostatic latent images on the photosensitive members 3K, 3Y, 3M and 3C are developed by the developing devices 5K, 5Y, 5M and 5C to form toner images on the surfaces of the photosensitive members 3K, 3Y, 3M and 3C, respectively. At the same time, a drive motor (not shown) drives one of the first roller 14, the second roller 15, and the third roller 16 to thereby cause the intermediate transfer belt 10 to rotate. The images respectively formed on the surfaces of the four photosensitive members 3K, 3Y, 3M and 3C are sequentially transferred onto the intermediate transfer belt 10 one above the other in accordance with the rotation of the intermediate transfer belt 10, completing a full-color image on the outer circumferential surface of the intermediate transfer belt 10.

One of the sheet feeding rollers 42 of the sheet feeding unit 200 is selectively rotated, and recording media P from one of the sheet feeding cassettes 44 is extracted and fed one-by-one, by the sheet separating roller 45, to the sheet feeding path 46. Each sheet of recording media P is guided on the sheet feeding path 45 within the printer section 100 by sheet conveying rollers 47, and stops moving upon hitting the resist roller 49. Or, the sheet feeding roller 50 rotates to extract recording media P from the manual sheet feeding tray 51, the sheet separating roller 52 separates recording media P one-by-one into the sheet feeding path 53, and the flow of the manually fed recording sheet is stopped by hitting against the register roller 49.

Then, the register roller 49 rotates to align with the composite color image on the intermediate transfer belt 10, and the recording media P at the register roller 49 is fed into the secondary image transferring nip, which is a formed by the contact of the intermediate transfer belt 10 and the secondary image transferring roller 22. The composite color image is transferred onto the recording media P by the effects of an electrical field for image transfer and contact pressure in the secondary transferring nip.

The secondary image transferring device 29 conveys the paper sheet carrying the toner image to the fixing device 25. The fixing device 25 fixes the toner image on the sheet with heat and pressure.

In a simplex copy mode, a path selector 55 steers the sheet toward an outlet roller pair 56, so that the paper sheet is driven out to a copy tray 57 via the outlet roller pair 56. In a duplex copy mode, the path selector 55 steers the sheet into the turning device 28. The turning device 28 turns the sheet upside down and then delivers the upside down sheet to the secondary image transfer position. After a toner image is formed on the reverse side of the same paper sheet, the outlet roller pair 54 drives the paper sheet to the copy tray 57.

After the secondary image transfer, the intermediate transfer belt cleaning device 17 removes the residual toner remaining on the outer circumferential surface of the intermediate transfer belt 10 to thereby prepare the intermediate transfer belt 10 for the next image formation.

An exemplary first embodiment of image forming devices of the present invention is now described.

Figure 2A:
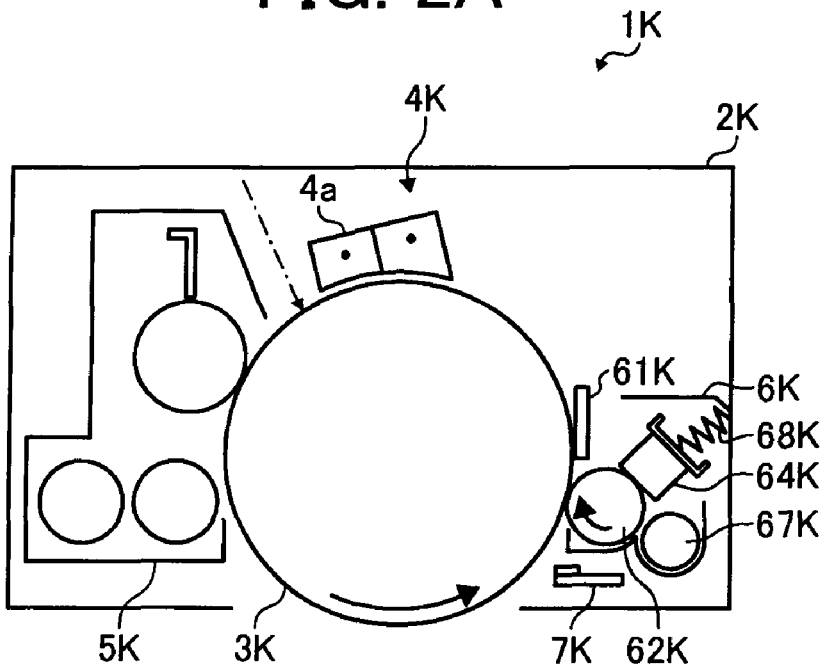
FIG. 2A is a schematic structure of an image forming device used for forming black images according to a first embodiment of the present invention.
Figure 2B:
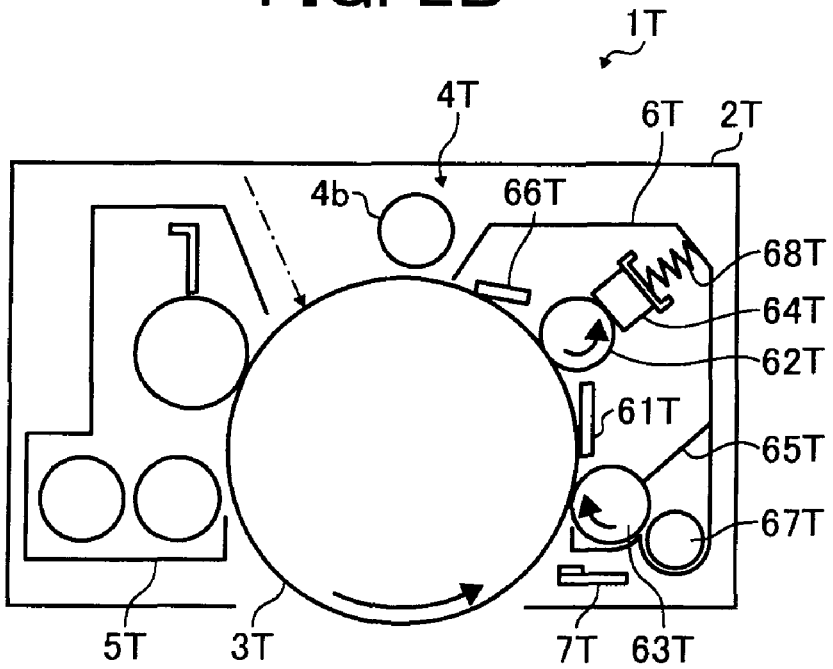
FIG. 2B is a schematic structure of an image forming device used for forming color images according to the first embodiment of the present invention.

FIG. 2A shows an image forming device 1K used for forming a black image, and FIG. 2B shows an image forming device 1T used for forming any one of a cyan color image, a magenta color image, or a yellow color image.

As illustrated in FIGS. 2A and 2B, respectively, each image forming device 1K, 1T includes a photosensitive member 3K, 3T and a process device such as a charging device 4K, 4T, a developing device 5K, 5T, and a lubricant supplying device 6K, 6T. Each image forming device 1K, 1T including the photosensitive member 3K, 3T, the charging device 4K, 4T, the developing device 5K, 5T, and the lubricant supplying device 6K, 6T within a unit case 2K, 2T is detachable from a body of the image forming apparatus as a process cartridge. In this embodiment, each image forming device 1K, 1T itself is replaceable, but it is possible that each photosensitive member 3K, 3T, charging device 4K, 4T, developing device 5K, 5T, and lubricant supplying device 6K, 6T themselves can be replaceable.

As illustrated in FIG. 2A, the charging device 4K of the image forming device 1K includes a charging wire 4*a*, serving as a charging unit. The charging wire 4*a* is applied a charging bias having a direct current component.

As illustrated in FIG. 2B, the charging device 4T of the image forming device 1T includes a non-contact charging roller 4*b*, serving as a charging unit. The charging roller 4*b* is applied a charging bias having a direct current component and an alternate current component.

Thereby, as described above, there is a difference between the charging device 4K of the image forming device 1K and the charging device 4T of the image forming device 1T. In addition, the lubricant supplying devices 6K, 6T are different in correspondence to the different charging devices. That is, there is a difference between the lubricant supplying device 6K of the image forming device 1K and the lubricant supplying device 6T of the image forming device 1T.

Referring to FIG. 2A, the following describes the lubricant supplying device 6K of the image forming device 1K. The lubricant supplying device 6K of the image forming device 1K includes a lubricant body 64K made of, e.g., solid zinc stearate as a lubricant and a lubricant supplying brush 62K supplying the lubricant to the surface of the photosensitive member 3K as a lubricant supplying member.

The image forming device 1K includes a cleaning blade 61K as a cleaning unit to remove residual toners remaining on the surface of the photosensitive member 3K.

The cleaning blade 61K is arranged downstream of the supplying brush 62K in the rotating direction of the photosensitive member 3K. The image forming device 1K includes a precleaning discharge lamp 7K upstream of the lubricant supplying device 6K in the rotating direction of the photosensitive member 3K.

The lubricant body 64K is mounted on a bracket and pressed against the lubricant supplying brush 62K by a pressuring spring 68K. The lubricant supplying brush 62K rotates in a same direction as the rotating direction of the photosensitive member 3K. The lubricant supplying brush 62K wipes the lubricant body 64K to supply the lubricant onto the surface of the photosensitive member 3K.

The precleaning discharge lamp 7K discharges the surface of the photosensitive member 3K passing a first transferring portion.

The supplying brush 62K supplies the lubricant to the surface of the photosensitive member 3K, while the supplying brush 62K scrapes residual toners remaining the surface of the photosensitive member 3K. The supplying brush 62K rotates in a same direction as the rotating direction of the photosensitive member 3K, and rotates at a linear speed that is different from the linear speed of the photosensitive member 3K. However, the supplying brush 62K may rotate in a direction opposite to the photosensitive member 3K.

The cleaning blade 61K removes residual toner remaining on the surface of the photosensitive member 3K scraped by the supplying brush 62, while the cleaning blade 61K regulates the lubricant applied on the surface of the photosensitive member 3K to form a thin layer. The cleaning blade 61K is fixed by a bracket (not shown) rotatably held. The cleaning blade 61K contacts the surface of the photosensitive member 3K in a direction opposite to the rotating direction of the photosensitive member 3K.

A motor (not shown) rotates the supplying brush 62K wiping the lubricant body 64K to apply an amount of the lubricant to the surface of the photosensitive member 3K at 0.08 [g/km] per one kilometer of the photosensitive member 3K.

Referring to FIG. 2B, the following describes the lubricant supplying device 6T of the image forming device 1T. The lubricant supplying device 6T of the image forming device 1T includes a lubricant body 64T made of, e.g., solid zinc stearate as a lubricant and a lubricant supplying brush 62T supplying the lubricant to the surface of the photosensitive member 3T as a lubricant supplying member.

The lubricant supplying device 6T includes a precleaning discharge lamp 7T, a cleaning brush 63T, a cleaning blade 61T, a lubricant supplying brush 62T, and a lubricating blade 66T downstream in the rotating direction of the photosensitive member 3T.

The cleaning brush 63T scrapes residual toners remaining on the surface of the photosensitive member 3T to make it easy to remove residual toners remaining the surface of the photosensitive member 3T.

A flicker 65T removes the residual toner adhered on the cleaning brush 63T. The residual toner removed by the flicker 65T is conveyed outside of the cleaning device 6T by a conveying auger 67T.

The lubricant supplying device 6T includes the cleaning brush 63T and the cleaning blade 61T to remove residual toners remaining the surface of the photosensitive member 3T.

The lubricating blade 66T is arranged downstream of the lubricant supplying brush 62T in the rotating direction of the photosensitive member 3T.

The lubricant body 64T is mounted on a bracket and pressed against the lubricant supplying brush 62T by a pressuring spring 68T.

The lubricant supplying brush 62T rotates in a direction opposite to the rotating direction of the photosensitive member 3T. The lubricant supplying brush 62T wipes the lubricant body 64T to supply the lubricant onto the surface of the photosensitive member 3T.

The precleaning discharge lamp 7T discharges the surface of the photosensitive member 3T passing the first transferring portion.

The cleaning brush 63T scrapes residual toners remaining on the surface of the photosensitive member 3T, and removes residual toner remaining on the surface of the photosensitive member 3T scraped by the cleaning brush 63T.

The lubricating blade 66T contacts the surface of the photosensitive member 3T with its trailing edge, i.e., in a same direction relative to the rotating direction of the photosensitive member 3T, to form a thin layer of lubricant on the surface of the photosensitive member 3T. The cleaning blade 61T is fixed by a bracket (not shown) rotatably held. The cleaning blade 61T contacts the surface of the photosensitive member 3T in a direction opposite to the rotating direction of the photosensitive member 3T. The cleaning blade 61T is pressed by a pressuring spring (not shown) against the photosensitive member 3T to remove residual toner on the surface of the photosensitive member 3T.

The cleaning brush 63T rotates in a same direction as the rotating direction of the photosensitive member 3T, and rotates at a linear speed that is different from the linear speed of the photosensitive member 3T. However, the cleaning brush 63T may rotate in a direction opposite to the photosensitive member 3T.

A motor (not shown) rotates the supplying brush 62T wiping the lubricant body 64T to apply an amount of the lubricant to the surface of the photosensitive member 3T at 0.13 [g/km] per one kilometer of the photosensitive member 3T.

As described above, a structure of the charging device 4K of the image forming device 1K for forming black toner image is not the same as a structure of the charging devices 4T of the image forming devices 1T for forming other color toner images.

In this embodiment, the charging device 4K of the black image forming device 1K, which is more frequently used than other colors by user, includes the charger 4*a* including a charging wire and a grid. The charger 4*a* applies a charging bias having a direct current component (referred to as "DC charge type" hereinafter).

On the other hand, the charging device 4T of the image forming devices 1Y, 1M, and 1C includes the charging roller 4*b*, which is a non-contact type charging member. The charging roller 4*b* applies a charging bias having an alternate current component and a direct current component (referred to as "AC+DC charge type" hereinafter).

In the case of applying the AC+DC charge type in FIG. 2B, the lubricants on the surface of the photosensitive member 3T are transformed by the alternate current component. The cleaning devices remove the transformed lubricants on the surface of the photosensitive member 3T, so the amount of the lubricant on the surface of the photosensitive member 3T decreases. Thus, in that case it is needed to supply additional lubricant to compensate for the removed transformed lubricant.

On the other hand, in the case of applying the DC charge type on FIG. 2A, the lubricants on the surface of the photosensitive member 3K are not transformed by an alternate current component, since an AC component is not applied. Thus, the proper amount of the applied lubricant in the case of the DC charge type is less than the proper amount of the applied lubricant in the case of the AC+DC charge type.

In this embodiment, the amount of the applied lubricant in the case of the lubricant supplying device 6K of the image forming device 1K of FIG. 2A including the DC charge type is less than the amount of the applied lubricant in the case of the lubricant supplying device 6T of the image forming device 1T of FIG. 2B including the AC+DC charge type.

The linear speed of the lubricant supplying brush 62K of the lubricant supplying device 6K of FIG. 2A is less than the linear speed of the lubricant supplying brush 62T of the lubricant supplying brush 62K of FIG. 2B. Thus, the amount of the lubricant applied to the surface 3K by the lubricant supplying device 6K of FIG. 2A is 0.08 [g/km] per one kilometer of the photosensitive member 3K, and the amount of the lubricant applied to the surface 3T by the lubricant supplying device 6T of FIG. 2B is 0.13 [g/km] per one kilometer of the photosensitive member 3T.

As described above, in the case of the DC charge type of FIG. 2A, the lubricant supplying device 6K supplies comparatively less amount of the lubricant based on the type of the charging device utilized. Thus, the lubricant supplying device 6K can restrain useless consumption of the lubricant, and the lubricant supplying device 6K can extend its life without enlarging the lubricant body 64T. Therefore, the image forming device 1K used for forming a black image, which is more frequently used than other colors, can extend its life with the combination of utilizing the DC charge type and using a comparatively little amount of the lubricant.

On the other hand, in the case of AC+DC charge type of FIG. 2B, the lubricant supplying device supplies a comparatively larger amount of the lubricant based on the type of the charging device utilized. The image forming device 1T used for forming a cyan color image, a magenta color image, and a yellow color image, which are less frequently used than forming a black color, can extend their life with the combination of utilizing the AC+DC charge type and using a comparatively larger amount of the lubricant.

The preceding discussion of the above-discussed embodiment has assumed lubricant supplying devices having different linear speeds of the supplying brushes between the image forming device 1K and the image forming device 1T to change the amount of the lubricant applied to the surfaces of the photosensitive members 3K, 3T, but the present invention is not limited only to such lubricant supplying devices. For example, a modification of the embodiment can utilize any of a different hardness of a lubricant body, a different characteristic feature of the lubricant supplying brush, such as a material of fiber and density, a different pressure of a pressuring spring 68K, 68T to press the lubricant body 64K, 64T against the lubricant supplying brush 62K, 62T, between the image forming device 1K and the image forming device 1T, or other ways of varying the lubricant supply.

There is an issue that in the embodiment of FIG. 2A the lubricant applied on the surface of the photosensitive member 3K may adhere to the charger 4*a* because the charger 4*a* is away from the surface of the photosensitive member 3. In addition, the charger 4*a* applies a charging bias having a direct current component, and the surface of the photosensitive member 3K is not transformed by an alternate current component.

Therefore, the image forming apparatus with this type of charger does not need to apply the lubricant onto the surface of the photosensitive member minutely compared with an image forming apparatus with another type of charger. And in the lubricant supplying device 6K of the image forming device 1K used for forming a black image in FIG. 2A, the brush 62K can function to clean and scratch residual toner on the surface of the photosensitive member and function to supply the lubricant to the surface of the photosensitive member 3K, thereby serving a double purpose, or the cleaning blade 61K of the image forming device 1K can function to also apply the lubricant on the surface of the photosensitive member 3K, thereby serving a double purpose.

As a result, the number of parts of the lubricant supplying device 6K of the image forming device 1K used for forming a black image can be reduced, and reduction of manufacture cost, space-saving, etc. can be attained.

On the other hand, as in FIG. 2B, a charging roller 4*b* of the image forming device 1T used for forming a color image is a non-contact type, and thereby it is harder for lubricant to stick on the surface of the photosensitive member 3T compared with a contact type charger. However, it is easier for lubricant to stick to the charging roller 4*b* from the surface of the photosensitive member 3T compared with the charger 4*a* of the image forming device 1K used for forming a black image.

In addition, because the charging roller 4*b* is applied a charging bias having a direct current component and an alternate current component, the lubricants on the surface of the photosensitive member 3T are transformed by the alternate current component. Thus, an image forming apparatus with the charging roller 4*b* needs to apply the lubricant onto the surface of the photosensitive member 3T more minutely compared with the image forming apparatus with the charger 4*a*.

The surface of the photosensitive member 3T is cleaned by the cleaning brush 63T and the cleaning blade 61T, and after that, the surface of the photosensitive member 3T is applied the lubricant by the lubricant supplying brush 62T. And, the lubricating blade 66T regulates the lubricant on the surface of the photosensitive member 3T uniformly. Thus, the lubricant can be applied on the surface of the photosensitive member 3T minutely.

The lubricant minutely applied on the surface of the photosensitive member is harder to peel off from the surface of the photosensitive member 3T. This lubricant on the surface of the photosensitive member 3T is also harder to be transformed by the alternate current component, and that can extend the lifetime of the photosensitive member 3T.

The following describes an exemplary second embodiment of image forming devices of the present invention.

Figure 3A:
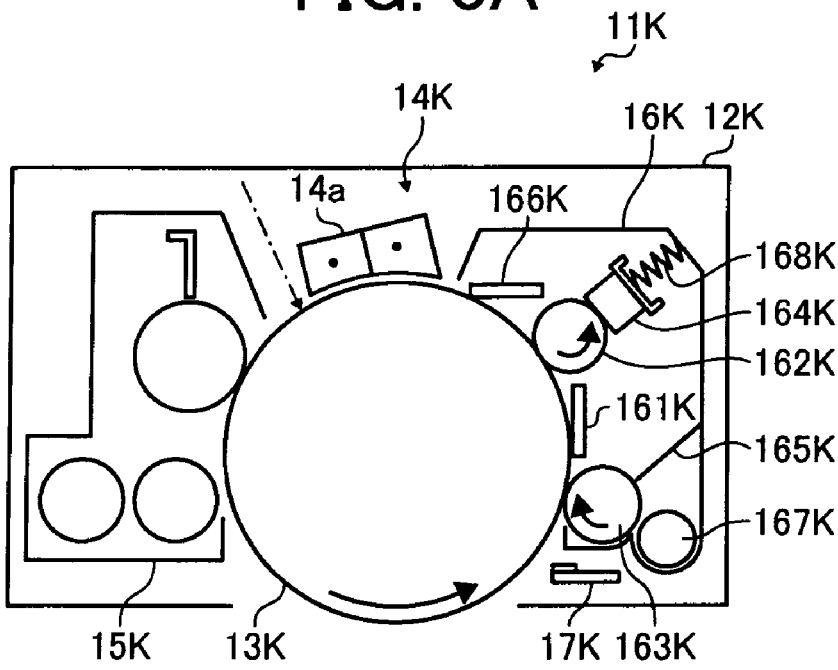
FIG. 3A is a schematic structure of an image forming device used for forming black images according to a second embodiment of the present invention.
Figure 3B:
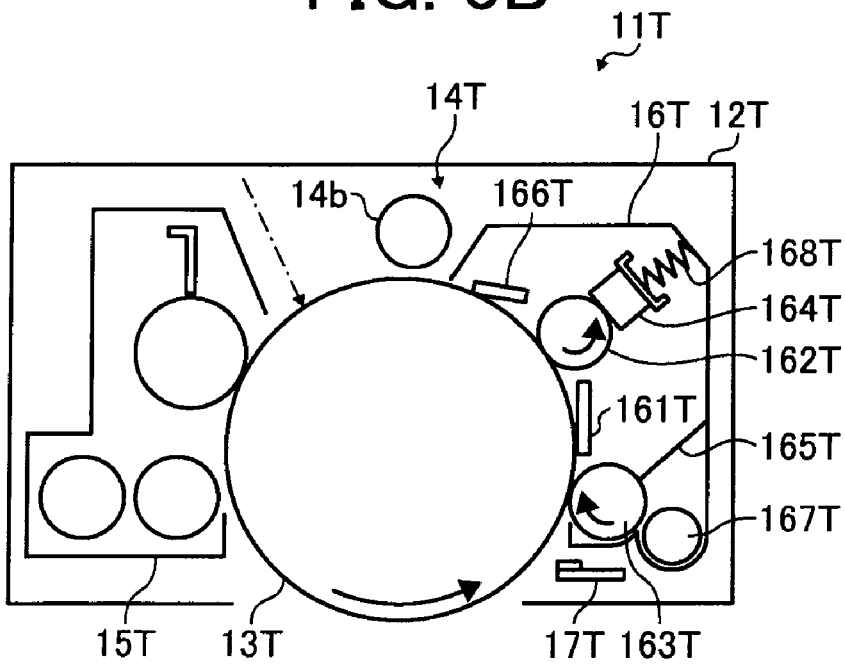
FIG. 3B is a schematic structure of an image forming device used for forming color images according to the second embodiment of the present invention.

FIG. 3A shows an image forming device 11K used for forming a black image, and FIG. 3B shows an image forming device 1T used for forming any one of a cyan color image, a magenta color image, or a yellow color image.

As illustrated in FIG. 3A, the image forming device 11K for forming a black image of the second embodiment includes a lubricant supplying device 16K, which has the same structure as the lubricant supplying device 6T for forming a color image of the first embodiment of FIG. 2B. The lubricant supplying device 16K includes a precleaning discharge lamp 17K, a cleaning brush 163K, a cleaning blade 161K, a lubricant supplying brush 162K, and a lubricating blade 166K in the rotating direction of the photosensitive member 13K. These structures act the same as corresponding structures of the lubricant supplying device 6T (of FIG. 2B) for forming a color image, respectively.

In addition, as illustrated in FIG. 3B, the image forming device 11T for forming a color image of the second embodiment has the same structure as the image forming device 1T for forming a color image of the first embodiment of FIG. 2B.

Although structures of the lubricant supplying devices 16K and 16T are the same, a rotating speed of the lubricant supplying brush 162K of the image forming device 11K used for forming the black image is different from a rotating speed of the lubricant supplying brush 162T of the image forming device 11T for forming the color image. Specifically, the rotating speed of the lubricant supplying brush 162T of the image forming device 1T used for forming the color image is greater than the rotating speed of the lubricant supplying brush 162K of the image forming device 11K for forming the black image.

The lubricating blades 66T, 166K and 166T respectively contact the surfaces of the photosensitive members 3T, 13K and 13T in a same direction as the rotating direction of the photosensitive members 3T, 13K and 13T, i.e., with their trailing edges, but the present invention is not limited only to such lubricating blades. For example, the lubricating blades 66T, 166K and 166T can contact the surfaces of the photosensitive members 3T, 13K and 13T in a direction opposite to the rotating direction of the photosensitive members 3T, 13K and 13T, i.e., with their leading edges.

Lubricating blades contacting the surfaces of the photosensitive members in a direction opposite to the rotating direction of the photosensitive members can regulate the lubricant applied onto the surface of the photosensitive members more minutely than if the lubricating blades contact the surfaces of the photosensitive members in a same direction as the rotating direction of the photosensitive members.

On the other hand, lubricating blades contacting the surfaces of the photosensitive members in a same direction as the rotating direction of the photosensitive members can reduce friction between the lubricating blades and the photosensitive members and can reduce an influence of a driving device of the photosensitive members compared with lubricating blades contacting the surface of the photosensitive members in a direction opposite to the rotating direction of the photosensitive members.

As described above, the direction of the lubricating blades contacting the photosensitive members changes the minuteness of the lubricant applied onto the surfaces of the photosensitive members, but the present invention is not limited only to changing such a direction. For example, changing the material, the thickness, the pressure, etc. of the lubricating blades can also change the minuteness of the lubricant applied onto the surfaces of the photosensitive members.

The following describes an exemplary third embodiment of image forming devices of the present invention.

Figure 4A:
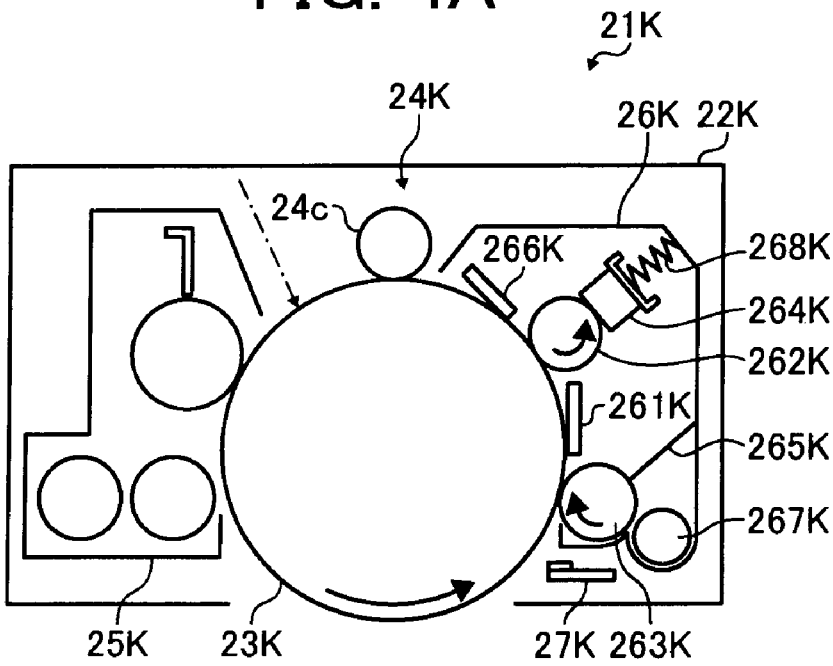
FIG. 4A is a schematic structure of an image forming device used for forming black images according to a third embodiment of the present invention.
Figure 4B:
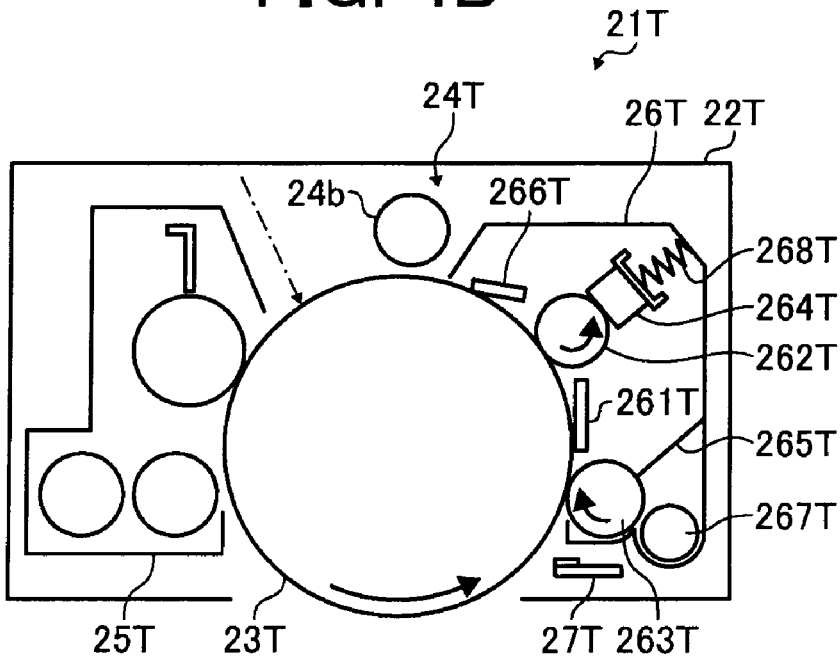
FIG. 4B is a schematic structure of an image forming device used for forming black images according to the third embodiment of the present invention.

FIG. 4A shows an image forming device 21 used for forming a black image, and FIG. 4B shows an image forming device 21 used for forming any one of a cyan color image, a magenta color image, or a yellow color image.

The image forming device 21K of FIG. 4A used for forming a black image has a different constitution of a charging device 24K from the charging device 4K of FIG. 2A, and has a different constitution of a lubricant supplying device 26K from the lubricant supplying device 6K of FIG. 2A. Except for the charging device and lubricant supplying device, the constitution of the image forming device 21K of FIG. 4A used for forming a black image has the same constitution of the image forming device 1K of FIG. 2A.

In addition, the constitution of the lubricant supplying device 26T of FIG. 4B used for forming the color image is the same constitution as the lubricant supplying device 6T of FIG. 2B used for forming the color image.

As illustrated in FIG. 4A, the charging device 24K of the image forming device 21K used for forming the black image includes a contact type charging roller 24*c*, serving as a charging unit, which contacts the surface of the photosensitive member 23K. The contact type charging roller 24*c* is applied a charging bias having a direct current (DC) component.

On the other hand, the charging roller 24*b* of the image forming device 21T used for the forming color image is applied a charging bias having a direct current (DC) component and an alternate current (AC) component The constitution of the lubricant supplying device 26T of the image forming device 21T of FIG. 4B used for forming the color image is the same constitution as the lubricant supplying device 6T of the image forming device 1T of FIG. 2B used for forming the color image.

A contacting direction of the lubricating blade 266K to the photosensitive member 23K of the image forming device 21K used for forming the black image is different from a direction of the lubricating blade 266T to the photosensitive member 23T of the image forming device 21T used for forming the color image. The lubricating blade 266T of the image forming device 21T used for forming the color image contacts the surface of the photosensitive member 23T in a same direction as the rotating direction of the photosensitive member 23T. On the other hand, the lubricating blade 266K of the image forming device 21K used for forming the black image contacts the surface of the photosensitive member 23K in a direction opposite to the rotating direction of the photosensitive member 23K.

The charging device 24K of the image forming device 21K used for forming the black image includes a contact type charging roller 24*c* that contacts the surface of the photosensitive member 23K. Thus, the contact type charging roller 24*c* can more easily have the lubricant stick to the surface of the contact type charging roller 24*c* than the non-contact charging roller 24*b* of the image forming device 21T used for forming the color image.

If a charging unit is applied with a charging bias with the lubricant on the charging unit, a portion of the charge unit with the lubricant may not properly charge the surface of the photosensitive member, and faulty images may occur.

The lubricating blade 266K of the image forming device 21K, used for forming the black image that contacts the surface of the photosensitive member 23K in a direction opposite to the rotating direction of the photosensitive member 23K, can regulate the lubricant applied onto the surface of the photosensitive member more minutely than the lubricating blade 266T of the image forming device 21T used for forming color image, which contacts the surface of the photosensitive member 23T in a same direction as the rotating direction of the photosensitive member 23T.

Thus, the lubricant more minutely applied onto the surface of the photosensitive member 23K is harder to peel off from the surface of the photosensitive member 23K, which can prevent adherence of the lubricant onto the surface of the contact type charging roller 24*c*, and thereby can prevent occurrence of faulty images.

In addition, the charging device 24K of the image forming device 21K used for forming the black image is a DC charge type, and the charging device 24T of the image forming device 21T used for forming the color image is a AC+DC charge type.

Thus, a rotating speed of the lubricant supplying brush 262K of the image forming device 21K used for forming the black image is different from a rotating speed of the lubricant supplying brush 262T of the image forming device 21T used for forming the color image similarly as in the above first and second embodiments. Specifically, the rotating speed of the lubricant supplying brush 262T of the image forming device 21T used for forming the color image is greater than the rotating speed of the lubricant supplying brush 262K of the image forming device 21K used for forming the black image.

As described in the above first, second, and third embodiments, a constitution of a lubricant supplying device depends on a constitution of a charging device. Thus, the lubricant can be more effectively applied onto the surface of the photosensitive member, and lifetimes of the devices can be extended.

Table 1 following shows a combination of the constitutions of charging devices and the constitutions of a lubricant supplying devices.

TABLE 1

| A constitution of a charging device | | | A constitution of a lubricant supplying device | | | | |
|---|---|---|---|---|---|---|---|
| A charging member | Contact/non-contact type | A charging bias | A cleaning blade | Relative amount of lubricant | Relative precision of lubricant on a surface of a photosensitive member | A position to a cleaning blade | A supplying member |
| A charging wire | Non-contact type | DC | o | Little | Rough | Upstream of a cleaning blade | Supplied by a brush |
| A charging roller | Contact type | DC | o | Little | Very minutely | Downstream of a cleaning blade | Supplied by a brush and lubricated by a countering blade |
| A charging roller | Non-contact type | AC + DC | o | Much | Minutely | Downstream of a cleaning blade | Supplied by a brush and lubricated by a trailing blade |
| A charging roller | Contact type | AC + DC | o | Much | Very minutely | Downstream of a cleaning blade | Supplied by a brush and lubricated by a countering blade |

In a constitution of a lubricant supplying device, a cleaning blade "o" means this constitution of a lubricant supplying device needs at least a cleaning blade.

In a constitution of a lubricant supplying device, a supplying member is not limited to a brush, but other structures may be used that transfer the lubricant onto the surface of the photosensitive member.

In addition, a supplying member is not limited to a blade, which is also used to regulate the lubricant on the surface of the photosensitive member.

A blade in contact with its leading edge can lubricate more minutely than a blade in contact with its trailing edge.

As shown in Table 1, the image forming device with a charging wire, which is non-contact type and is applied with a charging bias having a direct current (DC) component, applies enough lubricant on the surface more roughly (less minutely) than an image forming devices with another type of charging member, such as a charging roller. Thus, the image forming device with a charging wire may better be used in image forming device 1K used for forming a black image as in the first embodiment of FIG. 2A.

And, a constitution of a charging device, which is DC charge type of a charging bias, does not easily transform the lubricant on the surface of the photosensitive member by an alternate current component, and thereby a lesser amount of a transformed lubricant is removed. Thus, an amount of a lubricant can be reduced.

An image forming device with a charging roller, which is a contact type and is applied with a charging bias having a direct current (DC) component, does not easily transform the lubricant on the surface of the photosensitive member, as no alternate current (AC) component is utilized, and thereby a lesser amount of a transformed lubricant is removed. Thus, an amount of a lubricant can be reduced.

And, as the charging roller contacts the surface of the photosensitive member, a precision of lubricant on the surface should be very minute to prevent adherence of the lubricant on the surface of the charging roller. To realize this application of the lubricant, a position of a lubricant supplying device is arranged downstream of the cleaning blade in the rotating direction of the photosensitive member to supply the lubricant onto the surface of the photosensitive member which is cleaned. And the lubricating blade contacts the surface of the photosensitive member in a direction opposite to the photosensitive member to apply lubricant onto the surface of the photosensitive member minutely.

An image forming device with a charging roller, which is non-contact type and is applied with a charging bias having an alternate current (AC) component and a direct current (DC) component, easily transforms the lubricant on the surface of the photosensitive member by the alternate current (AC) component, and the transformed lubricant is more easily removed. Thus, an amount of a lubricant to be applied can be increased.

And, because the charging roller is a non-contact type, a precision of applying lubricant onto the surface of the non-contact type charging device can be rougher than a precision of applying lubricant on the surface by a contact type charging device.

But, the non-contact type charging device may more easily have the lubricant on the surface of the photosensitive member stick thereto, than the charging wire of the image forming device. In addition, because the charging roller is applied a charging bias having a direct current (DC) component and an alternate current (AC) component, the lubricants on the surface of the photosensitive member are transformed by the alternate current component. Thus, this image forming apparatus can apply the lubricant onto the surface of the photosensitive member more minutely compared with the image forming apparatus with the charging wire.

To realize this application of the lubricant, a position of a lubricant supplying device is arranged downstream of the cleaning blade in the rotating direction of the photosensitive member to supply the lubricant on the surface of the photosensitive member which is cleaned. And, the lubricating blade of this image forming device contacts the surface of the photosensitive member with its trailing edge to the rotating direction of the photosensitive member.

An image forming device with a charging roller, which is a contact type and is applied with a charging bias having an alternate current (AC) component and a direct current (DC) component, easily transforms the lubricant on the surface of the photosensitive member by the alternate current (AC) component, and the transformed lubricant is more easily removed. Thus, an amount of a lubricant to be applied can be increased.

And, as the charging roller contacts the surface of the photosensitive member, a precision of lubricant on the surface should be very minute to prevent adherence of the lubricant on the surface of the charging roller.

To realize this application of the lubricant, a position of a lubricant supplying device is arranged downstream of the cleaning blade in the rotating direction of the photosensitive member to supply the lubricant onto the surface of the photosensitive member which is cleaned. And the lubricating blade contacts the surface of the photosensitive member with its leading edge to the rotating direction of the photosensitive member to apply the lubricant onto the surface of the photosensitive member minutely.

In addition, when the image forming device is detachable from a body of the image forming apparatus as a process cartridge, the image forming apparatus can provide an easier maintenance.

Obviously, numerous modifications and variations of the present invention are possible in light of the above teachings. It is therefore to be understood that within the scope of the appended claims, the invention may be practiced otherwise than as specifically described herein.

What is claim as new and desired to be secured by Letters Patent of the United States is:

1. An image forming apparatus, comprising:

at least first and second image forming devices, the first image forming device including a first photosensitive member, a first charging device to charge a surface of the first photosensitive member, and a first lubricant supplying device to supply a first lubricant to the surface of the first photosensitive member, the second image forming device including a second photosensitive member, a second charging device to charge a surface of the second photosensitive member, and a second lubricant supplying device to supply a second lubricant to the surface of the second photosensitive member, wherein the first charging device has a different constitution from a constitution of the second charging device, and the first lubricant supplying device has a different constitution from a constitution of the second lubricant supplying device, wherein the first and second image forming devices further include first and second cleaning members, respectively, and wherein the first lubricant supplying device is positioned upstream of the first cleaning member relative to a rotating direction of the first photosensitive member, and the second lubricant supplying device is positioned downstream of the second cleaning member relative to a rotating direction of the second photosensitive member.

2. An image forming apparatus according to claim 1, wherein:

the first charging device is applied with a charging bias having a direct current component, and the second charging device is applied with a charging bias having an alternating current component and a direct current component.

3. An image forming apparatus according to claim 2, wherein:

an amount of the first lubricant applied onto the surface of the first photosensitive member is different from an amount of the second lubricant applied onto the surface of the second photosensitive member.

4. An image forming apparatus according to claim 3, wherein:

an amount of the first lubricant applied onto the surface of the first photosensitive member is less than an amount of the second lubricant applied onto the surface of the second photosensitive member.

5. An image forming apparatus according to claim 4, wherein:

the first lubricant supplying device comprises a first solid lubricant and a first lubricant supplying brush and the second lubricant supplying device comprises a second solid lubricant and a second lubricant supplying brush, respectively, and a first rotating speed of the first lubricant supplying brush is less than a second rotating speed of the second lubricant supplying brush.

6. An image forming apparatus according to claim 1, wherein:

the first charging device contacts the surface of the first photosensitive member, and the second charging device does not contact the surface of the second photosensitive member.

7. An image forming apparatus according to claim 6, wherein:

the first lubricant supplying device comprises a first regulating member that regulates the first lubricant on the surface of the first photosensitive member.

8. An image forming apparatus according to claim 7, wherein:

the first lubricant is applied on the surface of the first photosensitive member more minutely than the second lubricant is applied on the surface of the second photosensitive member.

9. An image forming apparatus according to claim 8, wherein:

the first regulating member comprises a first lubricating blade that contacts the surface of the first photosensitive member with its leading edge in a same direction relative to a rotating direction of the first photosensitive member, and the second lubricating supplying device comprises a second lubricating blade that contacts the surface of the second photosensitive member with its trailing edge in a same direction relative to a rotating direction of the second photosensitive member.

10. An image forming apparatus according to claim 1, wherein:

the first charging device comprises a charging wire, and the second charging device comprises a charging roller.

11. An image forming apparatus according to claim 1, wherein:

the first and second image forming devices are detachably attached to the image forming apparatus.

12. An image forming apparatus, comprising:

at least first and second means for forming images, the first image forming means including a first photosensitive member, a first means for charging a surface of the first photosensitive member, and a first means for supplying first lubricant to the surface of the first photosensitive member, the second image forming means including a second photosensitive member, a second means for charging a surface of the second photosensitive member, and a second means for supplying second lubricant to the surface of the second photosensitive member, wherein the first means for charging has a different constitution from a constitution of the second means for charging, and the first means for supplying lubricant has a different constitution from a constitution of the second means for supplying lubricant, wherein the first and second image forming means further include first and second cleaning members, respectively, and wherein the first means for supplying first lubricant is positioned upstream of the first cleaning member relative to a rotating direction of the first photosensitive member, and the second means for supplying second lubricant is positioned downstream of the second cleaning member relative to a rotating direction of the second photosensitive member.

* * * * *